United States Patent [19]

Bähre et al.

[11] 4,092,839

[45] June 6, 1978

[54] DEVICE FOR THE WET-TREATMENT OF MOVING WEBS

[75] Inventors: Gerhard Bähre, Bendestorf; Jürgen Brauns, Buchholz (Nordheide); Willi Struck, Pinneberg, all of Germany

[73] Assignee: Artos Dr. Ing. Meier-Windhorst KG, Seevetal, Germany

[21] Appl. No.: 712,411

[22] Filed: Aug. 6, 1976

[30] Foreign Application Priority Data

| | | |
|---|---|---|
| Aug. 8, 1975 | Germany | 2535464 |
| Feb. 17, 1976 | Germany | 2606217 |

[51] Int. Cl.[2] ..... D06B 3/02; D06B 15/08

[52] U.S. Cl. ..... 68/19; 68/62; 68/181 R

[58] Field of Search ..... 68/5 D, 5 E, 19, 19.1, 68/20, 22 R, 27, 43, 62, 175, 181 R, 184, 205 R, 208; 15/256.5; 198/497, 498; 118/123, 124, 126

[56] References Cited

U.S. PATENT DOCUMENTS

| | | | |
|---|---|---|---|
| 761,107 | 5/1904 | Rovira | 68/5 E |
| 1,209,465 | 12/1916 | Matter | 68/5 E |
| 1,375,173 | 4/1921 | Plaisted | 198/497 X |
| 2,729,537 | 1/1956 | Lasley | 68/22 R X |
| 2,936,468 | 5/1960 | Iverson | 68/19 X |
| 3,381,506 | 5/1968 | Cram | 68/19 |
| 3,950,802 | 4/1976 | Schiffer et al. | 68/181 R X |

*Primary Examiner*—Philip R. Coe
*Attorney, Agent, or Firm*—Allison C. Collard

[57] ABSTRACT

A device for the continuous wet treatment of moving webs, particularly the washing and drying of textile webs, wherein the webs pass through a chamber over reversing rollers from top to bottom or from bottom to top in a substantially horizontal mode of travel, the device comprising in addition to the reversing rollers, guide rollers and squeezing rollers, and a plurality of wipers for stripping liquid off the web, some of said wipers being arranged in the free horizontal stretches between the several rollers.

9 Claims, 3 Drawing Figures

D
22
19
18
14
16
31
32
33
11
30
10
20
13
33
15
12
C 33
34
35
36

37
38

DEVICE FOR THE WET-TREATMENT OF MOVING WEBS

This invention relates to a device for the continuous wet treatment of moving webs, especially for washing and dyeing of moving textile webs or the like, wherein the webs pass through the treatment over reversing rollers from bottom to top or from top to bottom in substantially horizontal travel.

In such devices, the treatment liquid passes from higher levels to lower levels of the course of the web, either by catching the liquid and conveying it to a suitable place on the lower level web section, or simply due to gravity, by the penetration of the liquid through the web and its dripping down to the web section on the lower level. Due to the low inclination of the several web sections in the almost horizontal travel, the liquid cannot flow off fast enough and there is a tendency for the formation of pockets of liquid, which frequently lead to creases in the web of material. Moreover, in cases where the web consists of dense materials, e.g. densely beaten woven fabrics, it is difficult for the treatment liquid to pass through the webs, and liquid layers will buildinup on the webs, which will settle at the reversing spots between rollers and webs and in turn lead to a floating of the webs on the rollers, so that the travel of the webs becomes unsatisfactory.

The present invention has the object of providing a device which prevents the above mentioned shortcomings, more particularly the formation of liquid pockets in the webs and the floating of the web on the reversing and guiding rollers, and thus improves the travel through treatment devices of the type mentioned.

It is a further object of the invention, to provide means in the device which will effect a direct removal of liquid accumulations from the webs and thereby contribute to the improvement in the action of the treatment liquid on the webs.

According to the invention, these objects are achieved by providing special wipers in the device within the longer free stretches over which the web travels between reversing, guiding, and squeezing rollers, the wipers serving to strip the rollers of the treatment liquid. The wipers may have simply shaped flat, round, triangular or square profiles. However, they may also be equipped with guiding grooves or channels for the liquid wiped off the web, so that the liquid will not accumulate on some structural elements of the device and be returned from there to the web.

It has proven particularly advantageous to design the wipers to serve at the same time as spreading means for the web, so as the achieve an improvement of the guidance of the web as well as the removal of excessive treatment liquid. The wipers or the spreading means, respectively, may be designed as curved rollers or rods, in a manner known per se. In order to make the wipers adaptable to differing operational conditions, they may be made adjustable.

Other objects and features of the present invention will become apparent from the following detailed description when taken in connection with the accompanying drawing which disclose several embodiments of the invention. It is to be understood that the drawing is designed for the purposes of illustration only, and are not intended as a definition of the limits and scope of the invention disclosed.

In the drawing, wherein similar reference numerals denote similar elements throughout the several views:

FIG. 1 diagrammatically illustrates the device with the wipers in the elevation;

Figures 1, 2, 3:
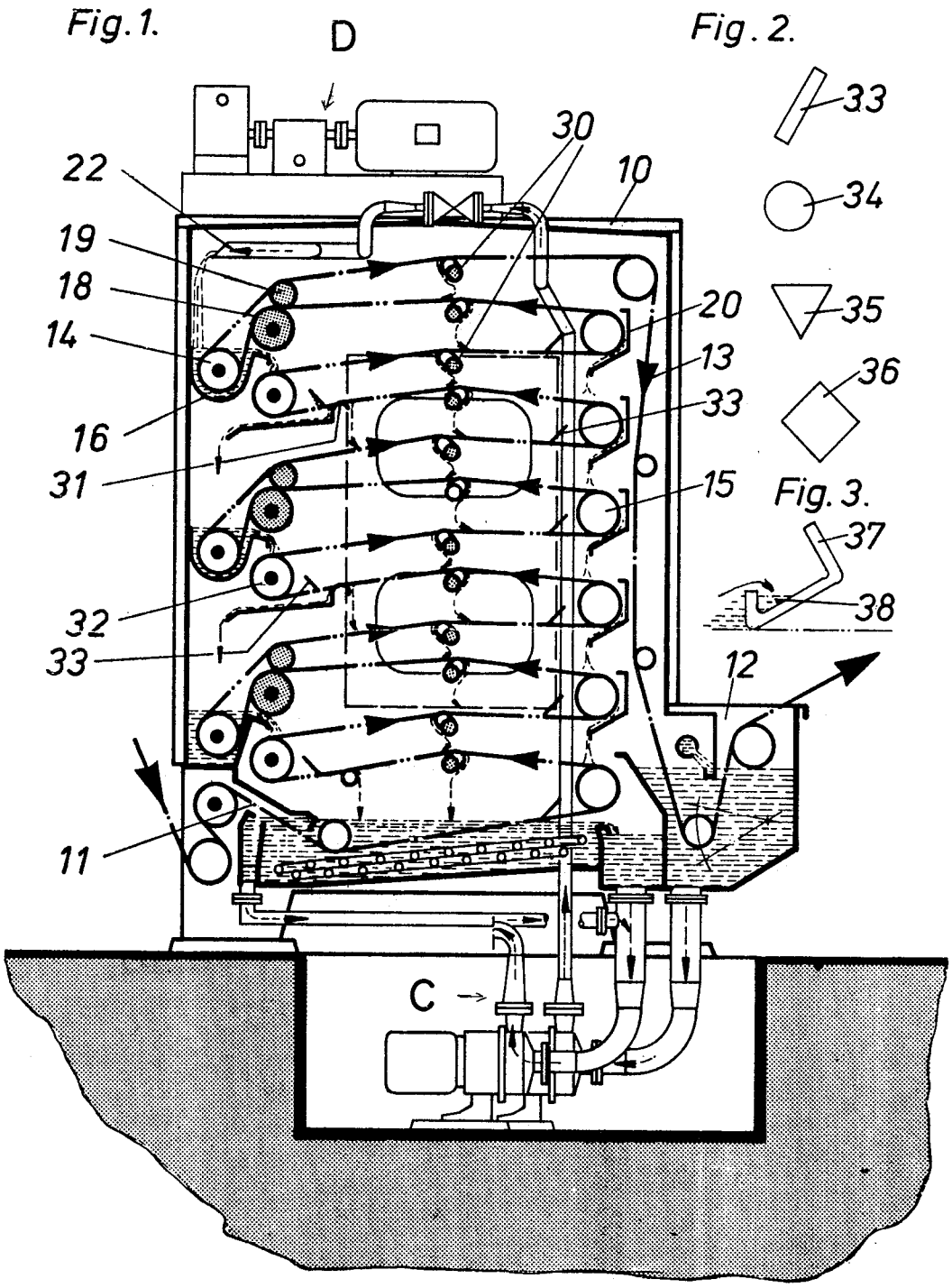
FIG. 2 shows profiles of solid wipers.
FIG. 3 shows one example of a wiper in channel form.

Referring now to FIG. 1, a housing 10 is shown having an inlet opening 11 and an outlet opening 12 for the web 13 to be treated. In the treatment chamber, a number of rollers are arranged in substantially vertical alignment, over which the web is conveyed from bottom to top in a principally horizontal course. The roller 14 shows at the left hand side, are placed in cup-shaped members 16 which serve to collect the treatment liquid. The rollers 15 at the right hand side are mounted adjustable, (at least in part) in order to enable the operator to regulate the tension of the web. Each time before a new soaking treatment is started, that is, before the web passes over rollers 14, there are rollers 18 and 19 arranged in its course which serve on the one hand as guide rollers for web 13, and on the other hand, as a squeezing means before the web enters the new soaking action in dishes 16. On the wall of the housing, particularly next to reversing rollers 15, known baffles are mounted, by which the liquid thrown off the web is returned into the treatment. Additionally, such baffles may, of course, be arranged laterally of the web on the housing wall. The treatment liquid reaches the uppermost cup 16 by means of a pipeline 22.

As may be seen from the figure, wipers 30 and 33 are arranged in the course between the reversing rollers and before each reversing roller 15 and 32, respectively. These serve to wipe off liquid from the web surface or its underside. As regards the liquid on the surface of the web, effects like the "aquaplaning" of motor vehicles could occur, which would cause the web to float on the reversing rollers whereby a faultless guidance of the web would be prevented.

FIG. 2 shows a variety of shapes for the wipers. Element 33 is a simple sheet wiper, 34 a round rod, 35 a triangular rod and 36 a square rod. The wipers can be adjustably mounted in order to correspond to the various operational conditions, i.e. especially to the differing permeability of the treated webs. Adjustability may also be considered necessary when the web is highly permeable, in which case the wiper is completely lifted off the web. Some adjustments involve the change of the wiper faces behind the wiper edges, especially in square rods. Wiper rods 30, shown in the illustrated embodiment and arranged about the center of the free stretches between rollers, are according to the invention, designed to serve also as spreading devices, and may be in the shape of curved rollers or rods, respectively; they are supposed to ensure a faultless guidance of the web in this substantially horizontal travel of web 13, even if the web is of a delicate nature. It is, of course, possible to have separate wipers and spreaders provided in the longer, free stretches of travel.

It is possible that the time for a satisfactory removal of the liquid by the wipers is too short, namely, when the liquid layers on the web are very substantial and the rate of travel of the web through the treatment chamber is very high. In such cases it is advantageous to use profiles 37 as shown in FIG. 3. These wipers contain special channels 38 for the withdrawal of the liquid. In that case, the liquid is stripped from the surface of the web and first collected in channel 38, and there is sufficient time for it to flow off laterally.

A driving mechanism D, shown schematically, is mounted on top of the housing, and a circulation system C for the treatment liquid is illustrated below the housing.

While only a single embodiment of the present invention has been shown and described, it will be obvious to those skilled in the art that many changes and modifications may be made thereunto without departing from the spirit and scope of the invention.

What is claimed is:

1. In a device for the continuous wet treatment of moving webs and, in particular, the washing and drying of textile webs, of the type including a chamber through which the web passes in a serpentine fashion along substantially horizontal travel paths supported by a plurality of horizontally spaced apart guiding rollers and reversing rollers between which are free, unsupported, horizontally-disposed stretches of the web said guiding rollers being disposed in a vertically-oriented column at one side of the chamber and said reversing rollers being disposed in a vertically oriented column at the other side of the chamber, the improvement comprising:

a first plurality of elongated wipers, each of which is mounted adjacent to one of the reversing rollers and is disposed to engage across the width of the upper surface of the horizontally disposed stretch of web so as to strip excess liquid therefrom and thereby prevent the web from floating on the reversing rollers;

a second plurality of elongated wipers, each of which is mounted adjacent to one of the guiding rollers and is disposed to engage across the width of the upper surface of the horizontally disposed stretch of web so as to strip excess liquid therefrom and thereby prevent the web from floating on the guiding rollers; and a third plurality of elongated wipers, each of which is mounted adjacent to the middle of one of the free unsupported stretches of the web and is disposed to engage across the width of the lower surface thereof so as to strip liquid therefrom and so as to provide positive guidance and support for the unsupported horizontally-disposed stretch of the web.

2. The device according to claim 1, wherein the profiles of the wipers are flat.

3. The device according to claim 1, wherein the profiles of the wipers are round.

4. The device according to claim 1, wherein the profiles of the wipers are triangular.

5. The device according to claim 1, wherein the profiles of the wipers are square.

6. The device according to claim 1, wherein the wipers are channel-shaped and thereby capable of collecting and discharging the liquid wiped off the web.

7. The device according to claim 1, wherein the wipers are in the form of curved rollers or rods.

8. The device according to claim 1, wherein the wipers are associated with means for making them adjustable.

9. The device according to claim 1, wherein cup shaped members are provided for some of the rollers, in which treatment liquid is collected so that the web passing therethrough is soaked.

* * * * *